US006164801A

United States Patent [19]

Alexander-Katz

[11] Patent Number: 6,164,801

[45] Date of Patent: Dec. 26, 2000

[54] PORTABLE LIGHTING SYSTEM

[75] Inventor: Didier Alexander-Katz, Naucalpan, Mexico

[73] Assignee: Teletec de Mexico, SA, DE CV., Naucalpan, Mexico

[21] Appl. No.: 09/346,674

[22] Filed: Jul. 2, 1999

[51] Int. Cl.[7] ..... F21S 3/12

[52] U.S. Cl. ..... 362/362; 362/154; 362/156; 362/1; 362/260; 362/225; 362/18; 362/17; 362/248; 362/252

[58] Field of Search ..... 362/154, 156, 362/1, 260, 225, 18, 17, 248, 252

[56] References Cited

U.S. PATENT DOCUMENTS

| | | | |
|---|---|---|---|
| D. 335,717 | 5/1993 | Couch . | |
| 3,852,582 | 12/1974 | Lowell . | |
| 4,181,928 | 1/1980 | Zelina . | |
| 4,249,237 | 2/1981 | Ronk et al. . | |
| 4,322,779 | 3/1982 | Böhme et al. . | |
| 4,400,763 | 8/1983 | Kribs et al. . | |
| 4,642,742 | 2/1987 | De Vos et al. . | |
| 4,669,033 | 5/1987 | Lee . | |
| 4,704,663 | 11/1987 | Ohashi . | |
| 4,782,428 | 11/1988 | Lowell et al. . | |
| 4,814,958 | 3/1989 | Hsieh . | |
| 4,839,783 | 6/1989 | Arai . | |
| 4,998,189 | 3/1991 | Guggemos . | |
| 5,083,253 | 1/1992 | Hahnel . | |
| 5,132,885 | 7/1992 | Hocheim et al. . | |
| 5,383,099 | 1/1995 | Peters . | |
| 5,455,756 | 10/1995 | Sumer et al. . | |
| 5,660,460 | 8/1997 | McLeod, Jr. . | |
| 5,685,421 | 11/1997 | Gilmore | 362/156 |
| 5,890,793 | 4/1999 | Stephens | 362/225 |

*Primary Examiner*—Sandra O'Shea
*Assistant Examiner*—Anabel M. Ton
*Attorney, Agent, or Firm*—Jagtiani & Associates

[57] ABSTRACT

An improved self-contained portable lighting system comprising: a first shell having an interior portion in which lights are mounted and having an exterior portion on which is mounted a first closure; a plurality of reflectors are mounted by hinges on edges of a front face of the interior portion of the first shell so that the reflectors may be folded on top of one another and substantially flat against the interior portion of the first shell; a second shell having an exterior portion including second closure for engaging the first closure and locking the first shell the said second shell together.

13 Claims, 5 Drawing Sheets

PORTABLE LIGHTING SYSTEM

BACKGROUND OF THE INVENTION

1. Field of the Invention

The present invention relates generally to lighting structures, and more particularly to a portable lighting suitcase suitable for use in the field of advertising photography, television, and motion pictures.

2. Description of the Prior Art

Proper lighting is of great importance with respect to advertising, photography, television, and motion pictures. There are varieties of lighting systems designed for use in connection with such industries. However, most such lighting systems are heavy, bulky, and not easily transportable.

Originally, film and television productions were made in studios and, therefore, the weight, size, and portability of lighting devices were not of concern. Recently, however, an increasing majority of films are shot on location away from studios and, therefore, need lightweight, small, and portable lighting systems which are also versatile and can be easily mounted in convenient and desirable positions.

Therefore, a lightweight, self-contained portable lighting system is greatly needed.

SUMMARY OF THE INVENTION

It is therefore an object of the present invention to provide a portable lighting suitcase which will contain all the elements necessary to set-up a portable light.

It is a further object to provide a self-contained portable lighting system that is stackable.

It is yet another object to provide a self-contained portable lighting system that is nestable.

It is yet another object to provide a self-contained portable lighting system that is capable of forming an array of lights.

In all of the above embodiments it is an object to provide a self-contained portable lighting system that is lightweight and easily transportable.

According to one broad aspect of the present invention, there is provided an improved self-contained portable lighting system comprising: a first shell having an interior portion in which lights are mounted and having an exterior portion on which is mounted a first closure; a plurality of reflectors are mounted by hinges on edges of a front face of the interior portion of the first shell so that the reflectors may be folded on top of one another and substantially flat against the interior portion of the first shell; a second shell having an exterior portion including second closure for engaging the first closure and locking the first shell the said second shell together.

According to another broad aspect of the invention, there is provided a carrying case for a self-contained portable lighting system comprising: a first shell having an interior portion including: light mounting means for mounting at least one light and an exterior portion on which is mounted a first closing means; a plurality of hinge means mounted on edges of a front face of the first shell interior portion the hinge means including engaging means for engaging reflectors to be mounted on the first shell; a second shell having an exterior portion including second closing means for engaging the first closing means and locking the first shell and the second shell together.

Other objects and features of the present invention will be apparent from the following detailed description of the preferred embodiment.

BRIEF DESCRIPTION OF THE DRAWINGS

The invention will be described in conjunction with the accompanying drawings, in which.

DETAILED DESCRIPTION OF THE PREFERRED EMBODIMENT

Definitions

For the purposes of the present invention, the term "stacking means" refers channels, recesses, ridges, knobs, dimples, raised regions, recessed regions, etc. on the surface of a first shell of a self-contained portable lighting system which mate with complementary channels, recesses, ridges, knobs, dimples, raised regions, recessed regions, etc. on the surface of a second shell of the same self-contained portable lighting system or on the surface of a shell of another self-contained portable lighting system. The stacking means may lock the two shells to each other, or may just prevent or restrict lateral movement of one shell with respect to the other mating shell. To allow a plurality of self-contained portable lighting systems of the present invention to be stacked on top of each other, the stacking means for each of the two shells of each self-contained portable lighting system should be complementary. Although only one combination of stacking means is explicitly shown for self-contained portable lighting system 10 of FIGS. 1 though 5, various types of known stacking means may be used for the purposes of the present invention.

For the purposes of the present invention, the term "rectilinear" refers to a generally rectangular shape which may have rounded or cut corners, such as rectilinear self-contained portable lighting system 10 of FIGS. 1 through 5.

For the purposes of the present invention, the term "self-contained" refers to the fact that the luminaire of the present invention is one of the two shells that make up the case of the present invention. The luminaire is not just placed in one of the shells, but instead, the luminaire is the shell.

Description

Figure 1:
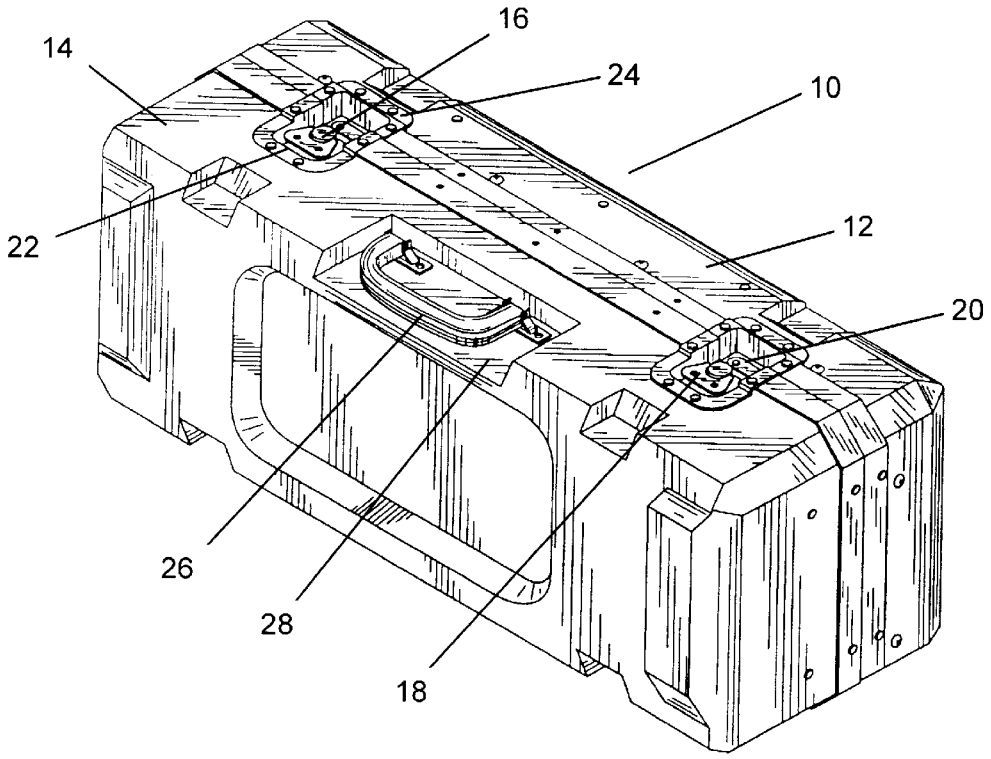
FIG. 1 is a perspective view of a closed portable lighting suitcase constructed in accordance with a preferred embodiment of the invention.

FIG. 1 shows a self-contained portable lighting system 10 of the present invention. Self-contained portable lighting system 10 includes a luminaire or light-containing shell 12 and a covering shell 14. On top of light-containing shell 12 and covering shell 14 are two conventional latch mechanisms 16. Each latch mechanism 16 consists of two pieces 18 and 20 located in complementary recesses 22 and 24 of light-containing shell 12 and covering shell 14, respectively. Not visible in FIG. 11 are two identical latch mechanisms at the bottoms of light-containing shell 12 and covering shell 14. A rotatable handle 26 located in a handle recess 28 is also mounted on the covering shell 14. Although in the embodiment shown, handle 26 for self-contained portable lighting system 10 is mounted on covering shell 14, in other embodiments of the present invention handle 26 may be mounted on light-containing shell 12 instead of covering shell 14.

Figure 2:
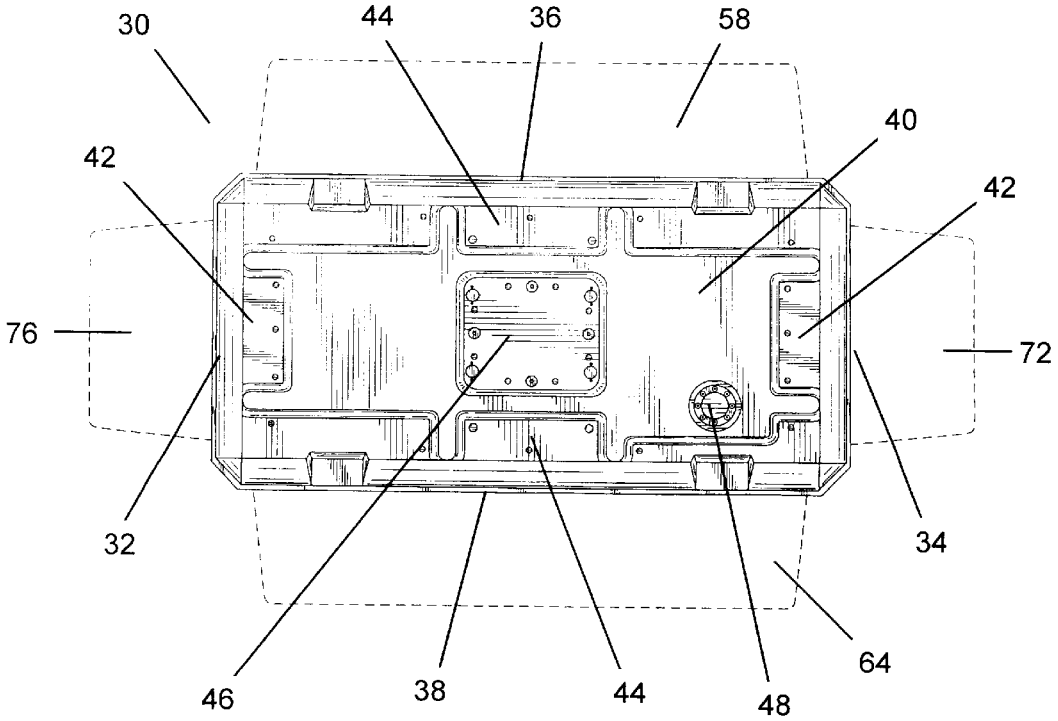
FIG. 2 is a plan view of an exterior portion of the light containing shell of the portable lighting suitcase of FIG. 1.

FIG. 2 shows an exterior portion 30 of light-containing shell 12. Exterior portion 30 includes two lateral short-sides 32 and 34, an upper long-side 36, a lower short-side 38, and a back face 40. Back face 40 includes two short-side stacking recesses 42 and two long-side stacking recesses 44 that function as part of a stacking means for light-containing shell 12. Back face 40 also includes a mounting region 46 on which a mounting bracket 206 (shown in FIG. 6) of a mounting post 204 (shown in FIG. 6) may be mounted. Back face 40 also includes a socket 48 into which a power plug or cord 216 (shown in FIG. 6) may be plugged.

Figure 3:
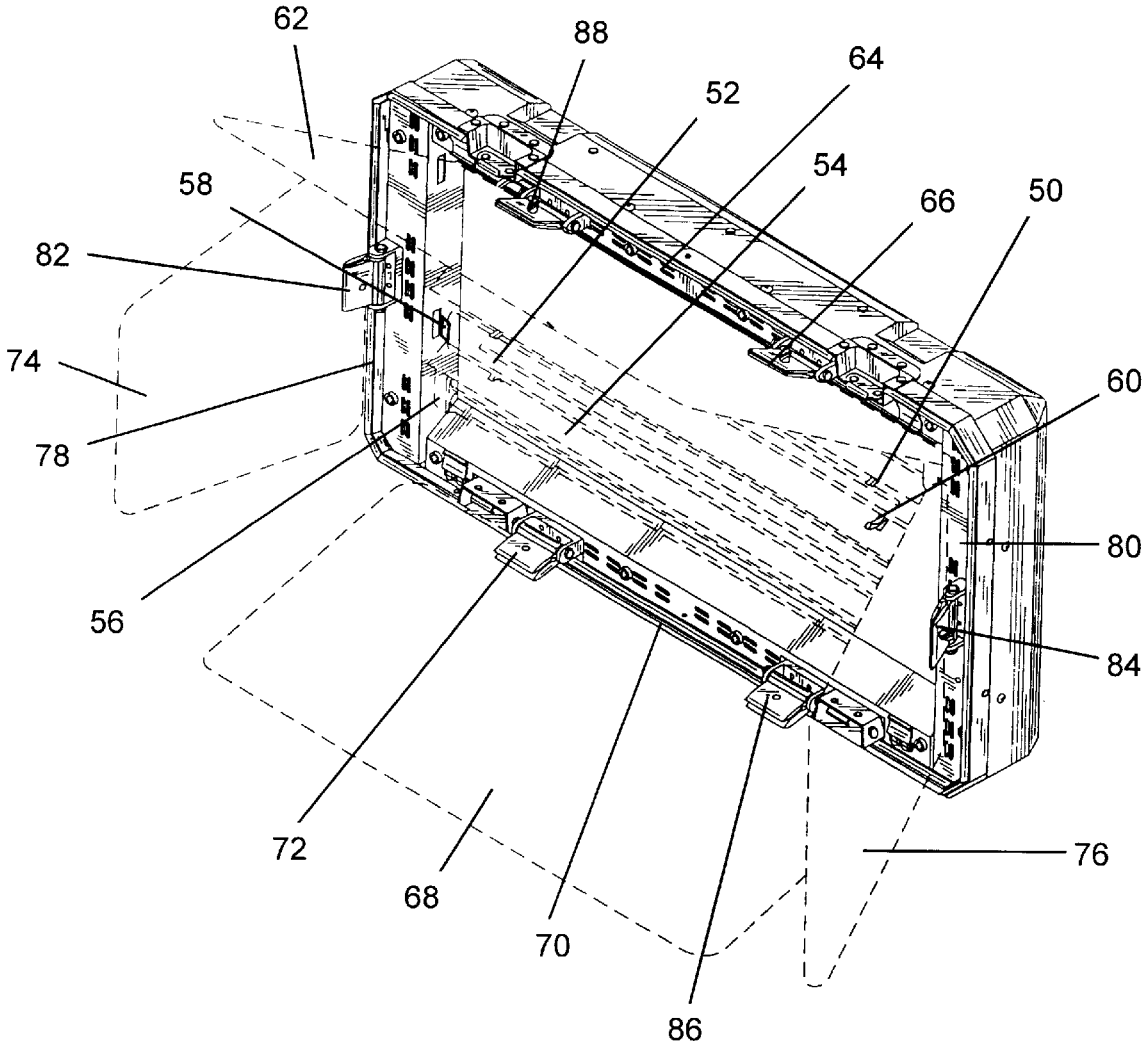
FIG. 3 is an isometric view of an interior portion of the light containing shell of the portable lighting suitcase of FIG. 1.

FIG. 3 shows an interior portion 50 of light-containing shell 12 when light containing shell 12 is deployed as a lighting device. A series of U-shaped tubular lights 52, shown in shadow lines to allow for details of interior portion 50 to be seen, are mounted in troughs 54, shown by shadow lines, extending across the length of interior portion 50 by snapping the ends of light 52 into two-hole sockets 56, shown by shadow lines. Each light 52 is further held in place by a mounting clip 58 and one or more mounting brackets 60. Troughs 54 are preferably made from a reflective material, such as a metal, or are coated with a reflective material to enhance the effects of lights 52. Although a particular kind of light and mounting set-up is shown in FIG. 3, self-contained portable lighting system 10 of the present invention may be used with a variety of different kinds of lights. An upper reflector 62 is mounted on an upper front edge 64 of interior portion 50 by a pair of upper hinges 66. Similarly, a lower reflector 68 is mounted on a lower front edge 70 of interior portion 54 by a pair of lower hinges 72. Two side reflectors 74 and 76 are mounted on respective side front edges 78 and 80 by respective side hinges 82 and 84. When not in use, hinges 66, 72, 82 and 84 allow reflectors 62, 68, 74 and 76, respectively, to be folded on top of each other over an open front face of interior portion 50. Thus, light-containing shell 12 is mated with covering shell 14. Hinges 66, 72, 82 and 84 include gripping members 86 into which reflectors 62, 68, 74 and 76, respectively, are inserted. Screws 88 are provided for tightening gripping members 86 to hold reflectors 62, 68, 74 and 76, respectively, in place.

Preferably, reflectors 62, 68, 74 and 76, are trapezoidal in shape, as shown in the embodiment of FIG. 1 so that reflectors 62, 68, 74 and 76, may be easily folded on top of one another. The number of hinges used to mount a reflector of the present invention may vary with the length of the reflector to be mounted. Depending on the application for which self-contained portable lighting system 10 of the present invention is used, reflectors 62, 68, 74 and 76, may be permanently mounted on hinges 66, 72, 82, and 84 or the hinges may be designed so that reflectors 62, 68, 74 and 76 are readily removable from hinges 66, 72, 82, and 84.

Figure 4:
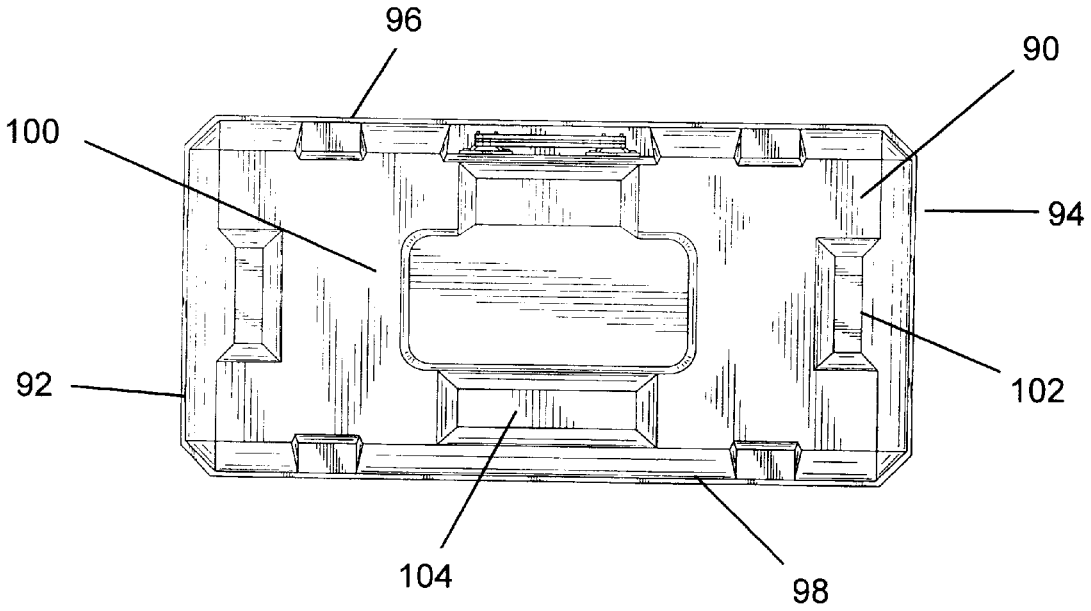
FIG. 4 is a plan view of an exterior portion of the covering shell of the portable lighting suitcase of FIG. 1.

FIG. 4 shows an exterior portion 90 of covering shell 14. Exterior portion 90 includes two lateral short-sides 92 and 94, an upper long-side 96, a lower long-side 98, and a back face 100. Back face 100 includes two short-side stacking ridges 102 and two long-side stacking ridges 104 that function as part of the stacking means for light-containing shell 12. When two self-contained portable lighting systems 10 of the type illustrated in FIG. 1 are stacked on top of each other, the stacking ridges of the back face of the covering shell of one of the cases is received by the stacking recesses of the back face of the light-containing shell of the second case.

Figure 5:
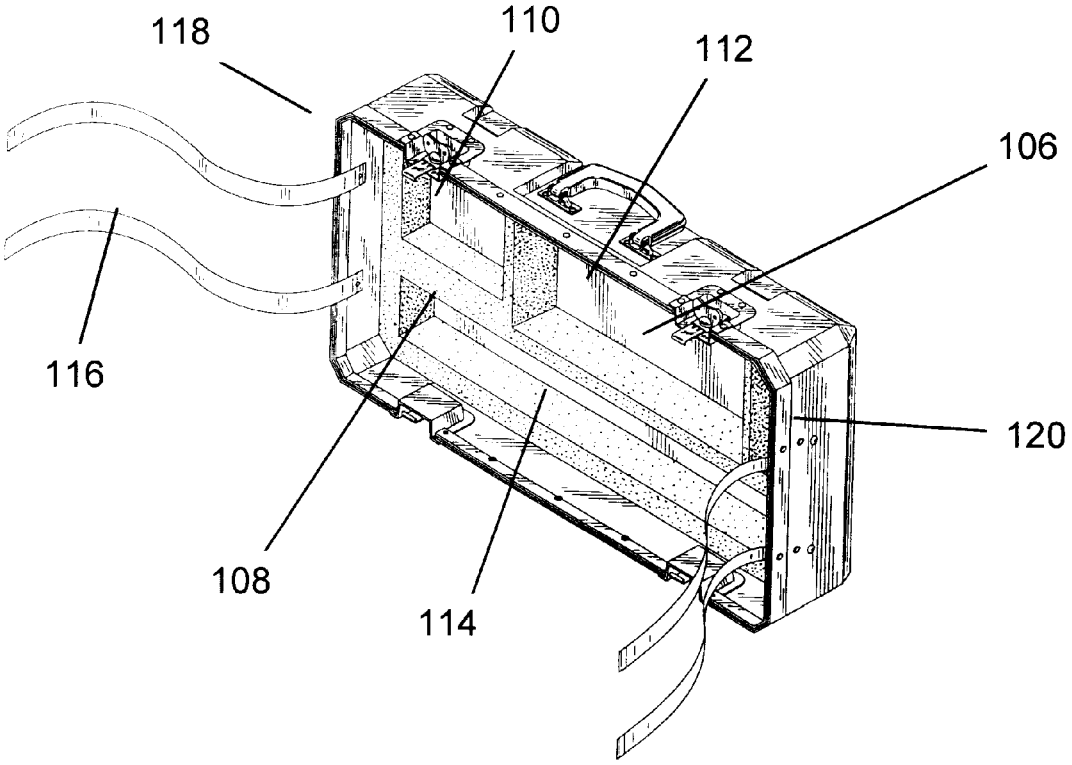
FIG. 5 is an isometric view of an interior portion of the covering shell of the portable lighting suitcase of FIG. 1.

FIG. 5 shows an interior portion 106 of covering shell 14. Mounted in interior portion 106 is a holding compartment 108 that is preferably made of a spongy material such as foam rubber or any other shock absorbent material. However, holding compartment 108 of the present invention may also be made of a rigid material such as plastic, metal or wood. In the embodiment of FIG. 5, holding compartment 108 includes 3 sub-compartments 110, 112, and 114. Although a particular number and arrangement of sub-compartments are shown in FIG. 5, holding compartment 108 of the present invention may have various number of sub-compartments arranged in a variety of ways. Accessories for lighting device/light-containing shell 12 may be stored in sub-compartments 110. 112, and 114. Examples of such accessories include such items as power cords 216, mounting brackets 206, mounting posts 204, spare lights, etc. Holding straps 116 are mounted on side walls 118 and 120 of interior portion 106 and may be used to hold accessories held in sub-compartments 110, 112 and 114 in place.

Figure 6:
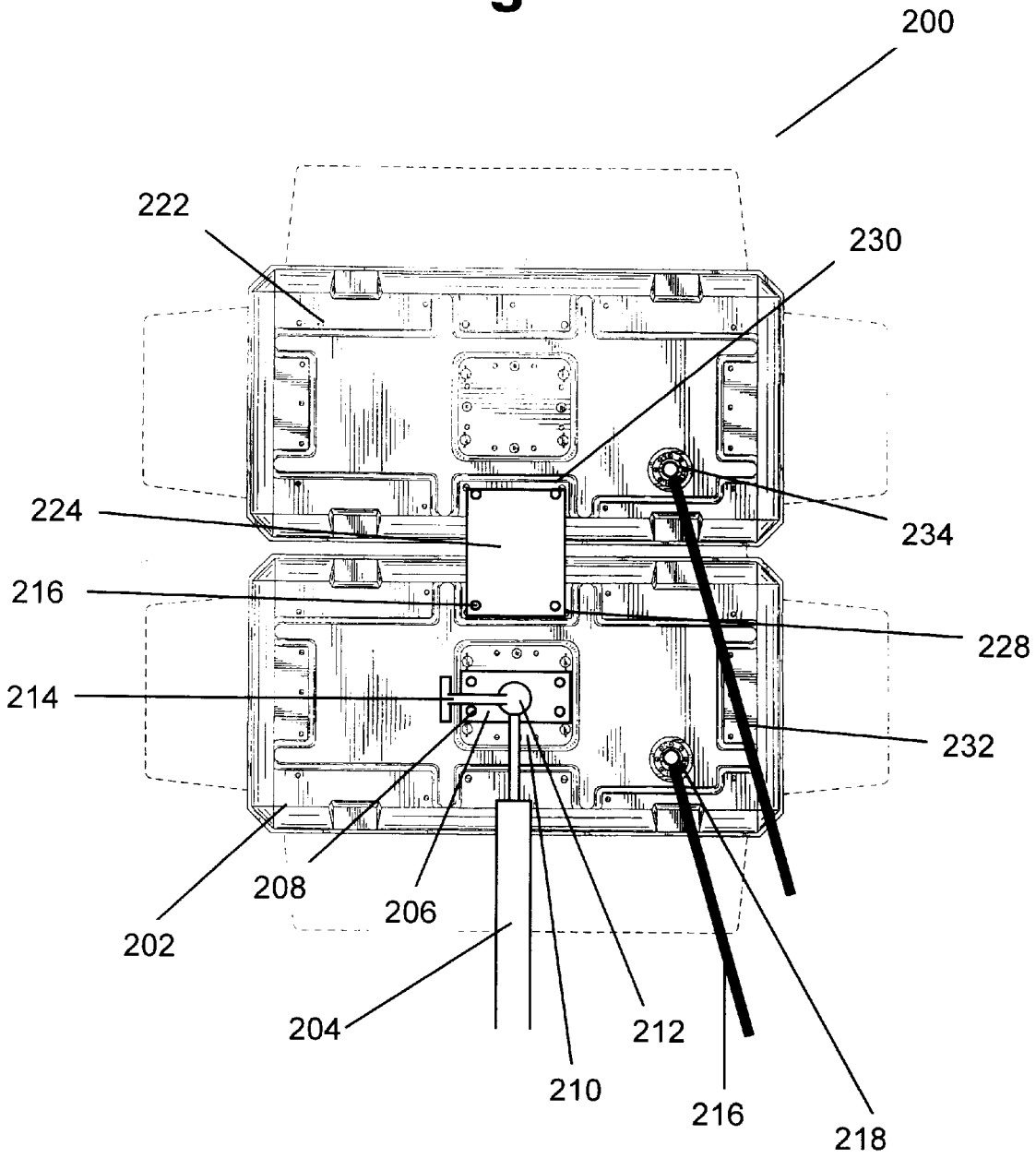
FIG. 6 is a plan view of an exterior portion of two light containing shells of the portable lighting suitcase of FIG. 1 which are attached to form an array of lights.

FIG. 6 illustrates a lighting system 200 of the present invention including a light-containing shell/lighting device 202 of the present invention mounted on a mounting post 204 and deployed as a lighting device. Mounting post 204 is attached to lighting device 202 by means of a bracket 206 and screws 208 mounted on a mounting region 210 of lighting device 202. Mounting post 204 includes a ball socket pivot device 212 having a handle 214 that may be used to adjust the orientation of lighting device 202. A power cord 216 is plugged into a socket 218 to power lighting device 202. In the lighting system 200 illustrated in FIG. 6, a second lighting device 222 is mounted on top of lighting device 202 by means of a connecting bracket 224 and screws 226. Connecting bracket 222 fits in two recessed regions 228 and 230 in lighting devices 202 and 222, respectively. A second power cord 232 is plugged into a socket 234 of power lighting device 222. Although only two lighting devices are shown mounted together, lighting systems of the present invention may include 3 or more lighting devices mounted one on top of another.

Although for convenience, FIGS. 1 through 6 show self-contained portable lighting systems of the present invention which are rectilinear boxes, the self-contained portable lighting system of the present invention may be other box shapes as well, such as circular, oval, lozenged-shape, etc.

Although the present invention has been fully described in conjunction with the preferred embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed:

1. A self-contained portable lighting system comprising:

a first shell having an interior portion in which a light means is mounted and having an exterior portion on which is mounted a first closing means;

a plurality of reflector means mounted by hinge means on edges of a front face of said interior portion of said first shell so that said reflector means may be folded on top of one another and substantially flat against said interior portion of said first shell; and a second shell having an exterior portion including a second closing means for engaging said first closing means and locking said first shell and said second shell together, wherein a back face of said first shell exterior portion includes a first stacking means and a back face of said second shell exterior portion includes a second stacking means for stackably engaging said first stacking means.

2. The self-contained portable lighting system of claim 5, further comprising a handle rotatably mounted on one member of the group consisting of the exterior portion of said first shell and the exterior portion of said second shell.

3. The self-contained portable lighting system of claim 5, further comprising a socket means for receiving power, said socket means being mounted on said exterior portion of said first shell and being electrically connected to said light means.

4. The self-contained portable lighting system of claim 5, further comprising a mounting region on a back face of said exterior portion of said first shell for engaging a mounting means on a mounting post.

5. The self-contained portable lighting system of claim 1, wherein said first stacking means comprises at least two recesses on said first shell exterior portion back face and said second stacking means comprises at least two raised regions on said second shell exterior portion back face, said at least two raised regions being complementary to said at least two recesses.

6. The self-contained portable lighting system of claim 1, wherein said first shell exterior back face and said second shell exterior back face are each substantially rectilinear, said first stacking means comprises four recesses, each of said recesses being located on one of four sides of said first shell exterior portion back face; and said second stacking means comprises four raised regions, each of said raised regions being located one of four sides of said second shell exterior back face, said four raised regions being complementary to said four recesses.

7. A carrying case for a self-contained portable lighting system comprising:

a first shell having an interior portion including: a light mounting means for mounting at least one light, and an exterior portion on which is mounted a first closing means;

a plurality of hinge means mounted on edges of a front face of said first shell interior portion, said hinge means including engaging means for engaging reflectors to be mounted on said first shell; and a second shell having an exterior portion including second closing means for engaging said first closing means and locking said first shell and said second shell together, wherein a back face of said first shell exterior portion includes a first stacking means and a back face of said second shell exterior portion includes second stacking means for stackably engaging said first stacking means.

8. The carrying case of claim 7, further comprising a plurality of reflector means, each of said reflector means engaging said engaging means of one of said hinge means so that said reflector means may be folded on top of one another and substantially flat against said interior portion of said first shell.

9. The carrying case of claim 7, further comprising a handle rotatably mounted on one member of a group consisting of the exterior portion of said first shell and the exterior portion of said second shell.

10. The carrying case of claim 7, further comprising a socket means for receiving power, said socket means being mounted on said exterior portion of said first shell and being electrically connected to said light mounting means.

11. The carrying case of claim 7, further comprising a mounting region on a back face of said exterior portion of said first shell for engaging a mounting means on a mounting post.

12. The carrying case of claim 7, wherein said first stacking means comprises at least two recesses on said first shell exterior portion back face and said second stacking means comprises at least two raised regions on said second shell exterior portion back face, said at least two raised regions being complementary to said at least two recesses.

13. The carrying case of claim 7, wherein said first shell exterior back face and said second shell exterior back face are each substantially rectilinear, said first stacking means comprises four recesses, each of said recesses being located on one of four sides of said first shell exterior portion back face; and said second stacking means comprises four raised regions, each of said raised regions being located one of four sides of said second shell exterior back face, said four raised regions being complementary to said four recesses.

* * * * *